United States Patent [19]

DiForte

[11] Patent Number: 5,022,879

[45] Date of Patent: Jun. 11, 1991

[54] INFLATABLE LIFE BELT

[76] Inventor: Mario P. DiForte, P.O. Box 8537, Baltimore, Md. 21234

[21] Appl. No.: 449,797

[22] Filed: Dec. 13, 1989

[51] Int. Cl.[5] ..... B63C 9/08

[52] U.S. Cl. ..... 441/113; 441/94; 441/108

[58] Field of Search ..... 441/92, 93, 94, 108, 441/109, 110, 111, 112, 113, 81

[56] References Cited

U.S. PATENT DOCUMENTS

| | | | |
|---|---|---|---|
| Re. 25,398 | 6/1963 | Moran | 441/111 |
| 1,493,664 | 5/1924 | Blum | 441/113 |
| 1,856,632 | 5/1932 | Haines | 441/113 |
| 2,001,384 | 5/1935 | Garvey | 441/113 |
| 2,324,744 | 7/1943 | Ward | 441/94 |
| 2,424,597 | 7/1947 | Werry | 441/94 |
| 2,451,474 | 10/1948 | Craig | 441/94 |
| 2,784,426 | 3/1957 | Boyle et al. | 441/113 |
| 3,009,175 | 11/1961 | Marston | 441/113 |
| 3,023,932 | 3/1962 | Hennis et al. | 441/94 |
| 3,727,252 | 4/1973 | Bauermeister | 441/122 |

FOREIGN PATENT DOCUMENTS

| | | | |
|---|---|---|---|
| 2068846 | 8/1981 | United Kingdom | 441/113 |

*Primary Examiner*—Sherman D. Basinger
*Assistant Examiner*—Thomas J. Brahan
*Attorney, Agent, or Firm*—Shlesinger Arkwright Garvey

[57] ABSTRACT

The present invention is an inflatable life belt of light weight, compact construction which is normally worn around the waist or hips of the individual, the size of which does not interfere with the activities of the individual while on board the ship, thereby rendering it feasible to use at all times without discomfort or in any way hindering normal physical activities. The belt encircles the body and is detachably engaged therewith by suitable belt means, the belt comprising two buoyancy sections of similar size which are folded one on top the other for sake of compactness. Each section of the belt includes a closed chamber; at least one of the chambers is automatically inflatable by suitable means such as a compressed gas cartridge mounted on the belt. The other closed chamber may be similarly inflated independently of the first chamber, or, alternatively, may be filled with an inherently buoyant material, such as foam, to render the life belt operative as soon as the individual enters the water.

14 Claims, 5 Drawing Sheets

INFLATABLE LIFE BELT

This invention is an inflatable life belt for use by boaters or the like and which may be quickly inflated to keep an individual float in the water.

BACKGROUND OF THE INVENTION

Over the years, many boaters have drowned as a result of a boating mishap or being thrown into the water in rough seas. In order to reduce these accidents, the U.S. Coast Guard has required that all boats must be equipped with an approved life vest for each person on board. It is not required, however, that the life vest be worn at all times and, consequently, very few persons on board actually wear the vests unless an emergency occurs. This is due to several factors, notably, the vests are cumbersome to wear, interfere with movements of the wearer about the boat while fishing and performing other activities, and the vests are hot to wear in warm weather.

As a consequence, there are many occasions when the boater does not have the time or opportunity to put on a life vest in an emergency prior to entering the water. This happens, for example, when two boats collide, when there is an explosion on board, or the boater is thrown overboard in rough seas.

Attempts have been made to provide alternative life preservers, but these also have proven unsatisfactory for many of the above reasons and, in many instances, do not have Coast Guard approval as required by law.

SUMMARY OF THE INVENTION

The present invention is an inflatable life belt of light weight, compact construction which is normally worn around the waist or hips of the individual, the size of which life belt does not interfere with the activities of the individual while on board the ship, thereby rendering it feasible to use at all times without discomfort or in any way hindering normal physical activities.

The belt of the present invention encircles the body and is detachably engaged therewith by suitable belt means, the belt comprising two buoyancy sections of similar size which are folded one on top the other for sake of compactness.

Each section of the belt includes a closed chamber at least one of which is automatically inflatable by suitable means such as a compressed gas cartridge mounted on the belt.

The other closed chamber may be similarly inflated independently of the first chamber or, alternatively, may be filled with an inherently buoyant material, such as foam, to render the life belt operative as soon as the individual enters the water.

In accordance with the objects of the present invention, upon entering the water, the buoyant life belt of the present invention rides upwardly on the torso of the individual from its initial position around the waist to the upward position just below the armpits, for holding the head of the individual above water.

DESCRIPTION OF FORM OF INVENTION ILLUSTRATED IN FIGS. 1 TO 8

Figure 1:
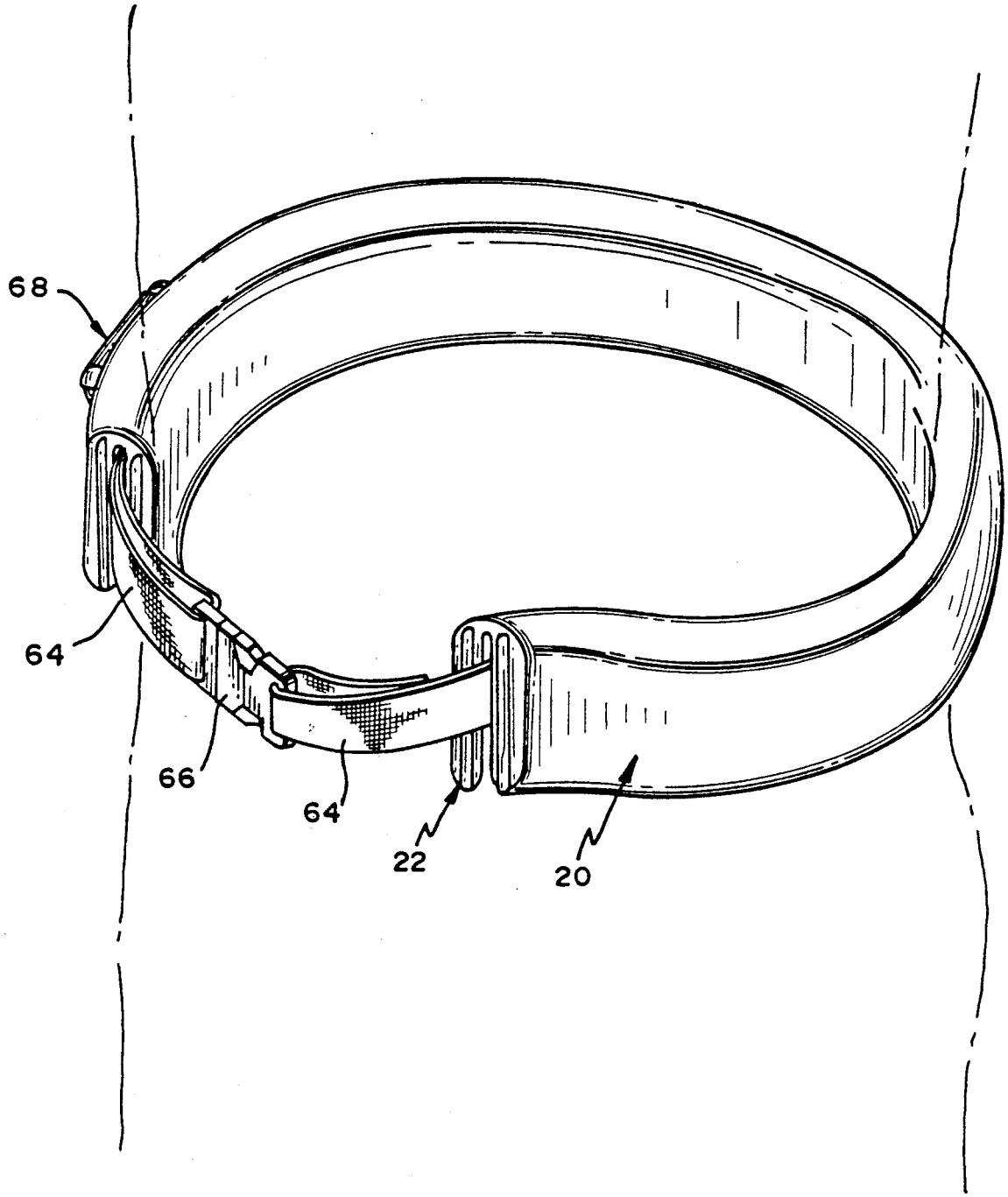
FIG. 1 is a perspective view of the inflatable life belt of the present invention, illustrating its use, and showing the life belt in operative position.
Figure 2:
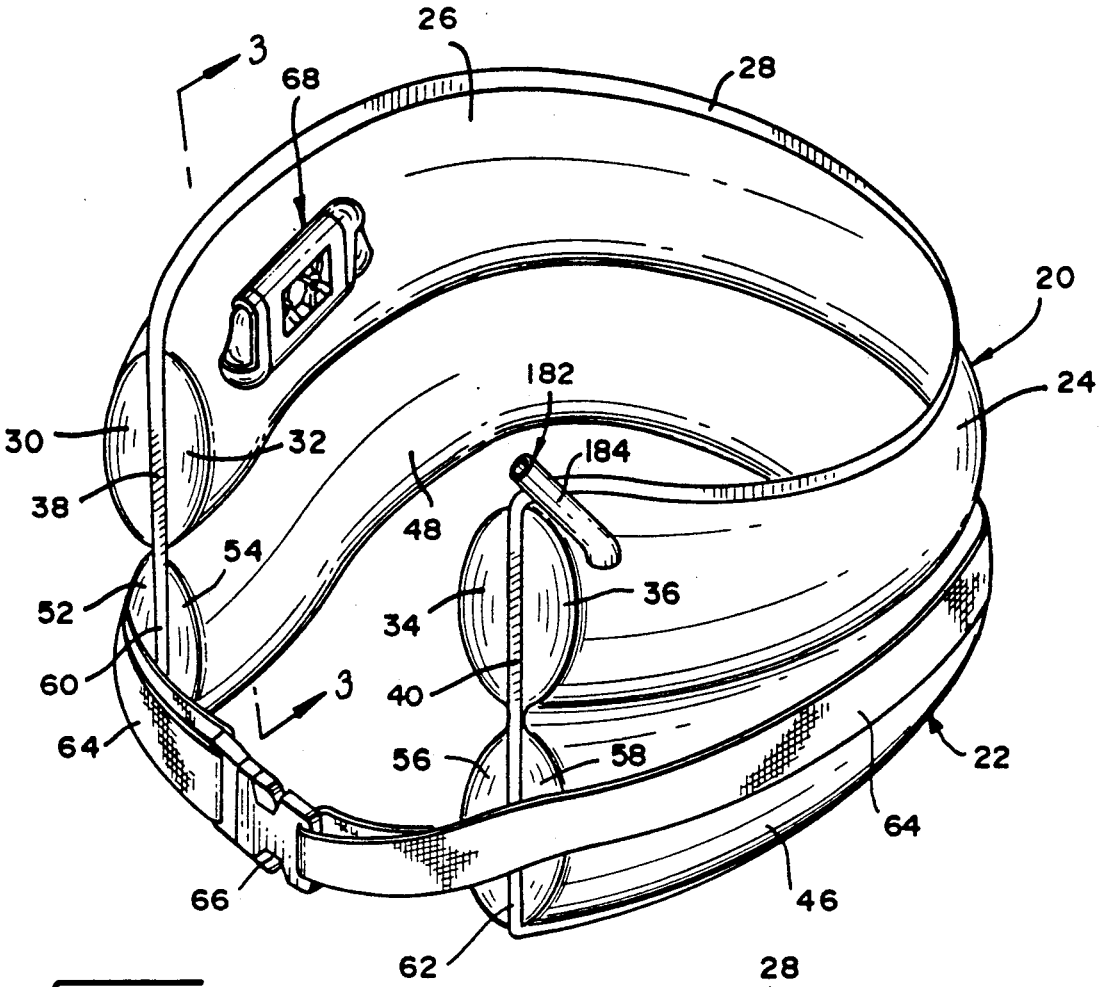
FIG. 2 is a view similar to FIG. 1 showing the life belt in operative position.
Figure 3:
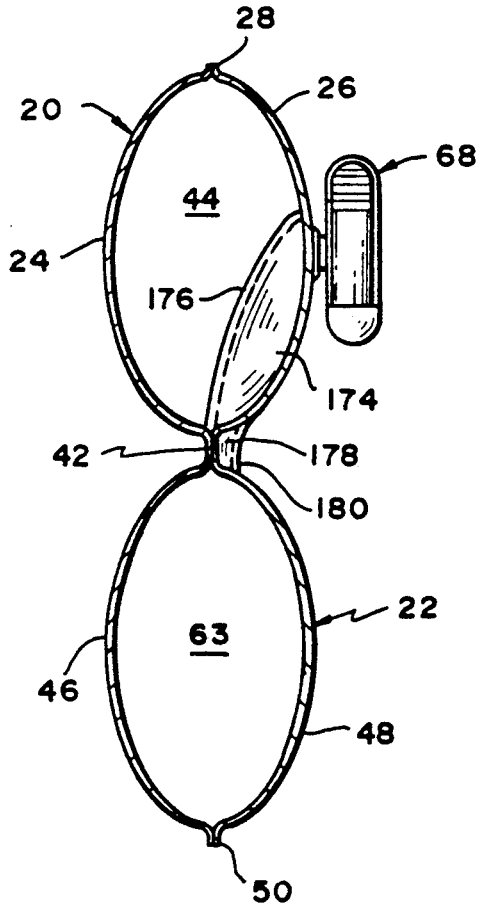
FIG. 3 is a sectional view taken along line 3—3 of FIG. 2, looking in the direction of the arrows.
Figure 4:
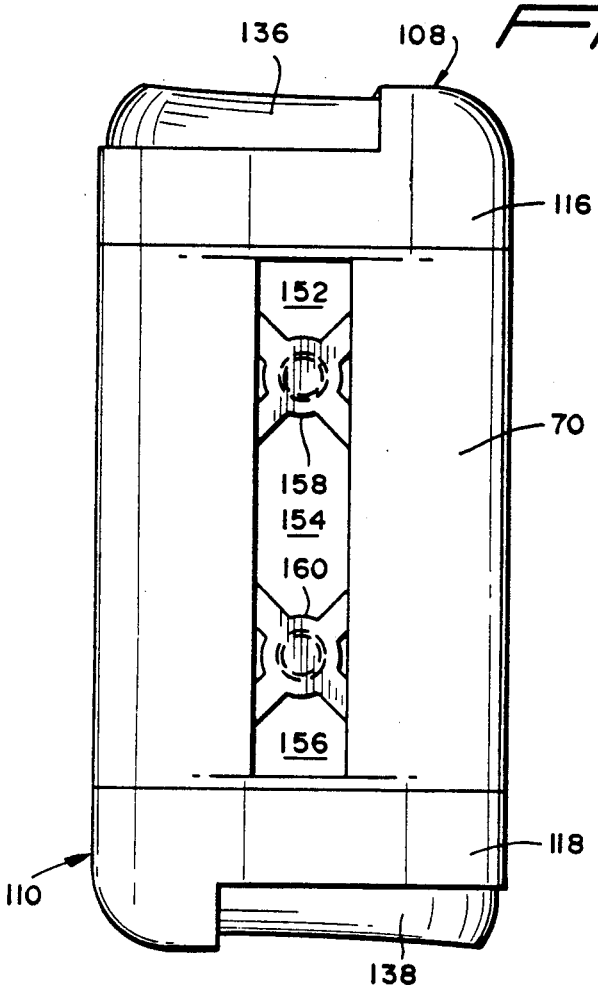
FIG. 4 is a front elevational view of an inflating actuator assembly forming a part of the present invention.

In FIGS. 1 to 8, there is illustrated an inflatable life belt which includes a pair of overlapped, light weight, inflatable buoyancy portions 20 and 22 made of a suitable flexible, waterproof material such as coated nylon. Each of portions 20 and 22 are of elongated, generally tubular shape and, when inflated, as shown in FIGS. 2 and 3, portion 20 is superimposed on portion 22.

As also shown in FIGS. 2 and 3, the side walls of portions 20 and 22 are preferably formed from two opposed pieces of the flexible material which are joined together in a manner to form the two inflatable portions.

Inflatable portion 20 includes opposed side walls 24 and 26, the upper longitudinal edges of which are sealed together in any suitable fashion as indicated at 28. The ends of the side walls are provided with end panels 30, 32 and 34, 36 and the edges are sealed together at 38 and 40. The lower edges of side walls 24 and 26 are also sealed together at 42. This forms a closed air chamber 44 within inflatable portion 20.

As shown to advantage in FIG. 3, the sealed edges 42 of sides 24 and 26 also serve as a seal for the upper edges of side walls 46 and 48 of inflatable lower portion 22. The lower longitudinal edges of side walls 46 and 48 are sealed together in any suitable manner as indicated at 50.

As shown in FIG. 2, the ends of walls 46 and 48 are closed by end panels designated 52 and 54, 56 and 58, the edges of which are sealed at 60 and 62, which are extensions of seals 38 and 40. This forms a closed air chamber 63.

Referring to FIG. 2, it will be seen that a belt member 64 having a conventional buckle 66 is fixedly engaged with the outer surface of side wall 48 of inflatable portion 22 to permit the inflatable life belt to be secured around the waist of the individual wearing the same.

By virtue of providing a pair of light weight, inflatable portions of the present construction, portion 20 may be folded over portion 22 so that, when the life belt is in its inoperative position, side wall 24 of inflatable portion 20 lies in contiguous engagement with side wall 46 of inflatable portion 22, thereby minimizing the thickness and width of the belt in its uninflated condition, with resultant reduced interference with the physical activities of the wearer.

It is a feature of the present invention to provide a gas cartridge inflation assembly 68 which is engaged with inflatable portion 20 of the life belt for automatically inflating portions 20 and 22 of the life belt.

Inflation assembly 68 is preferably of plastic molded construction and, as shown in FIGS. 4 to 8, includes a main body portion 70 having a pair of longitudinally extending, spaced wells 72 and 74 adapted to receive standard CO2 cartridges 76 and 78.

Each of wells 72 and 74 is extended at one end thereof to provide neck portions 80 and 82 which are externally threaded at 84 and 86.

Disks 88 and 90 are placed over the end wells 72 and 74, the disks being provided with inwardly extending flanges 92 and 94 which lie in contiguous engagement with the inner end of neck portions 80 and 82. Flanges 92 and 94 are in spaced relation to the outer periphery of disks 88 and 90, and O-rings 96 and 98 are interposed between disks 88 and 90 and the terminals of neck portions 80 and 82.

The outer faces of disks 88 and 90 are provided with central protuberances 100 and 102 in which are positioned pins 104 and 106 for piercing the upper end of cartridges 76 and 78.

The gas cartridge inflation assembly further includes a pair of actuator lever housings 108, 110 which comprise a base member of generally U-shaped cross-section which includes a bottom wall 112, 114, side walls 116, 118, and end walls 120, 122.

Figure 6:
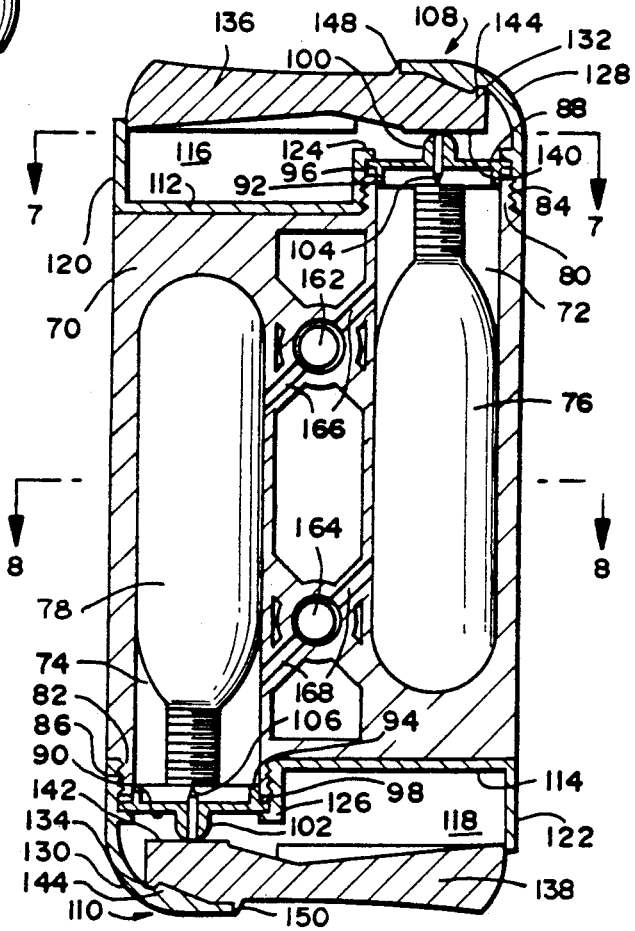
FIG. 6 is a longitudinal sectional view of the inflating actuator assembly.

As shown to advantage in FIG. 6, one end of actuating lever housing 108 is provided with an internally threaded tubular portion 124, 126 which is threadedly engaged with externally threaded neck portions 80, 82 of main body portion 70, for engaging the actuating lever housings with the main body portion.

One end of actuator lever housings 108, 110 are provided with curved walls 128, 130 which extend upwardly and inwardly of the housing in superimposed relation to disks 88, 90 of the assembly. The inner surfaces of walls 128, 130 are provided with abutment members 132, 134 for purposes which will be hereinafter more fully set out.

Actuating lever housings 108, 110 are adapted to receive elongated actuating levers 136, 138 which are movably supported in lever housings 108, 110. Actuating levers 136, 138 include flat bottom wall portions 140, 142 which are adapted to normally rest on central protuberances 100, 102 of disks 88, 90. Actuating levers 136, 138, are also provided with abutments 144, 146 Which complement, and are adapted to engage abutment members 132, 134 of curved walls 128, 130 of actuating lever housings 108, 110.

In association with abutment members 144, 146, there are provided second abutment members 148, 150 which engage the ends of curved walls 128, 130, the abutment members serving to maintain actuating levers 136, 138 within housings 108, 110 prior to actuation.

Figure 5:
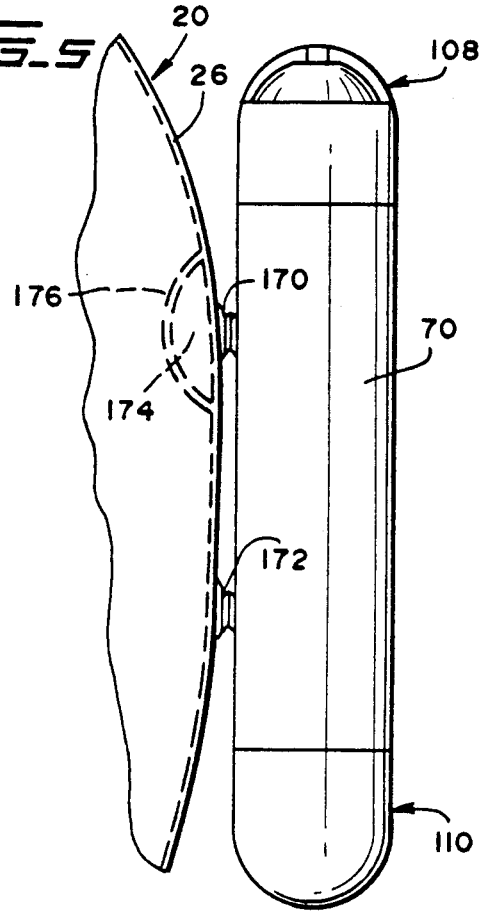
FIG. 5 is a side elevational view of the inflating actuator assembly shown in operative position attached to the inflatable life belt.

It will be noted from FIGS. 5 and 6 that, in order to make main body portion 70 as light weight as possible, there are provided openings indicated at 152, 154 and 156. These openings are separated by webs 158, 160 for joining the segments of the main body portion together. Webs 158, 160 include central openings 162, 164 for admitting compressed gas from cartridges 76 and 78 to the life belt through a series of tubular branches connecting openings 162, 164 to wells 72, 74, as indicated at 166, 168. As indicated in FIGS. 3 and 5, openings 162 and 164 of gas cartridge inflation assembly 68 are operatively engaged with inflatable portion 20 of the life belt by conventional valve means 170, 172 for admitting compressed air to inflatable portions 20 and 22 by actuation of levers 136 and 138. In view of the fact that the gas cartridge inflation assembly is engaged only with inflatable portion 20, there is provided a conduit 174 formed between a side wall 26 of inflatable portion 20 and a curved wall 176 which extends through inflatable portion 20 to inflatable portion 22, the ends of which curved wall are joined to side wall 48 in spaced relation to the valve 170.

As illustrated in FIG. 3, a connecting conduit 178 is formed between upper and lower inflatable portions 20 and 22 at seal 42 by means of a small wall 180 extending between wall 26 of inflatable portion 20 and wall 48 of inflatable portion 22.

As shown in FIG. 2, the life belt of the present invention is further provided with a manual inflater mechanism 182 which comprises a tube 184, one end of which is in communication with chamber 44 of inflatable portion 20. As shown to advantage in FIG. 2, tube 184 extends outwardly from the life belt at an angle to facilitate engagement of the free end of the tube by the mouth of the user for manually inflating the life belt if necessary.

OPERATION AND USE OF THE LIFE BELT ILLUSTRATED IN FIGS. 1 TO 8 OF THE DRAWINGS

The life belt is loosely placed around the waist of the user by fastening buckle 66, at which time portions 20 and 22 lie in overlapping relationship, and with the life belt in a position so it does not interfere with arm or leg movements during boating, or with other physical activities.

In the event that it becomes necessary to activate the life belt, actuating levers 136 and 138 of gas cartridge inflation assembly 68 are depressed, thereby causing a corresponding movement of pins 104 and 106 in a direction to pierce cartridges 76 and 78, to release the compressed gas contained therein.

The gas enters wells 72 and 74 and then passes through branches 166 and 168 of webs 158, 160, then it flows through openings 162, 164, and through valves 170, 172 into inflatable portion 20. A portion of the compressed air enters chamber 44, and the remaining portion flows to conduits 174 and 178 into chamber 63 of inflatable portion 22.

This causes the two portions of the belt to assume the position shown in FIGS. 2 and 3, with inflatable portion 20 in superjacent relation to inflatable portion 22.

Upon entering the water, because of the buoyancy of the inflatable portions of the life belt, the belt rises upwardly until it engages the armpits, at which point it is in the optimum position for maintaining the head of the wearer above water for an indefinite period of time.

In the event that inflation of portions 20 and 22 does not occur due to failure of the gas cartridges, then the wearer may inflate upper portion 20 of the life belt manually by blowing into the end of tube 184 of manual inflator 182 to effect sufficient buoyancy of the life belt to maintain the wearer of the belt above water.

DESCRIPTION OF FORM OF INVENTION ILLUSTRATED IN FIGS. 9 TO 12

In FIGS. 9 to 12, there is illustrated a modified form of the present invention generally designated 186, and wherein portions thereof which are similar to that disclosed in the form of invention illustrated in FIGS. 1 to 8 are designated by like, primed members.

In this form of invention, instead of providing a pair of air chambers which are inflatable by means of a gas cartridge, there are provided a pair of chambers, one of which, 20', is similar to inflatable portion 20 in the form of invention illustrated in FIGS. 1 through 8. However, in this form of the invention, there is provided a second noninflatable portion 200 which comprises a pair of flexible side walls 202 and 204 which are connected to portion 20' by seam 42', and the opposite ends of the sides are sealed at 206. In accordance with the objectives of this form of the invention, a foam block 208 is placed within portion 200 between walls 202, 204 which is coextensive therewith. Foam block 208 may be made of any suitable material such as a closed cell foam of high buoyancy, called ENSOLITE which is a Coast Guard approved material.

Figure 9:
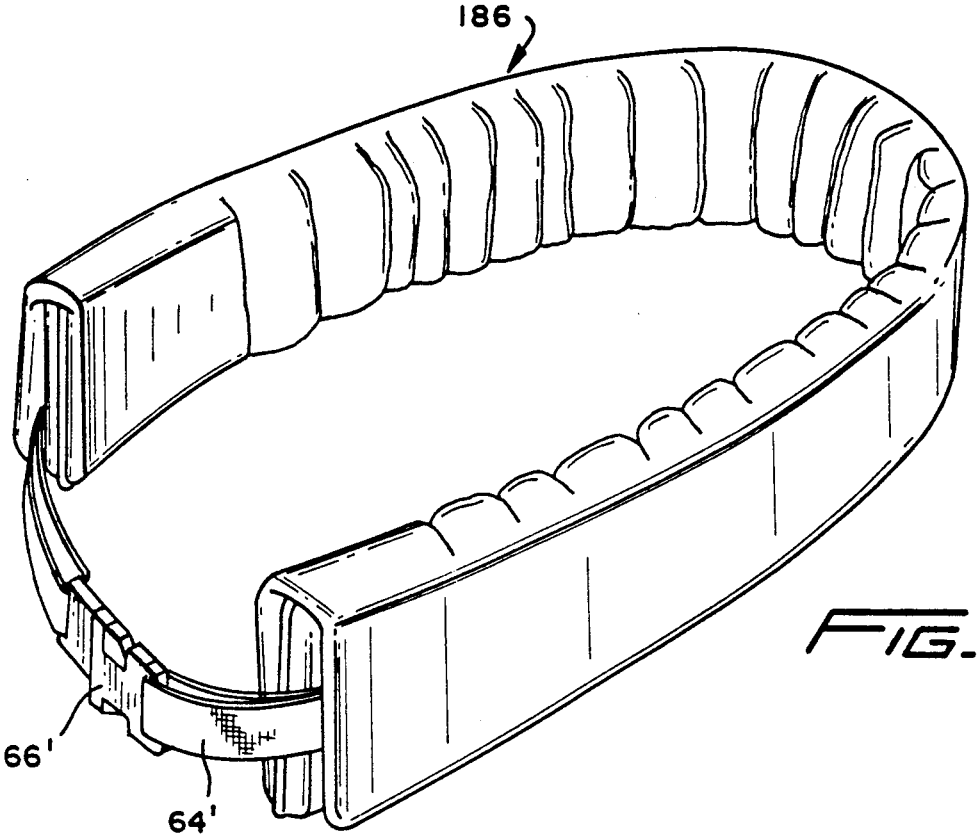
FIG. 9 is a perspective view of a modified form of an inflatable life belt, showing the same in operative position.
Figure 10:
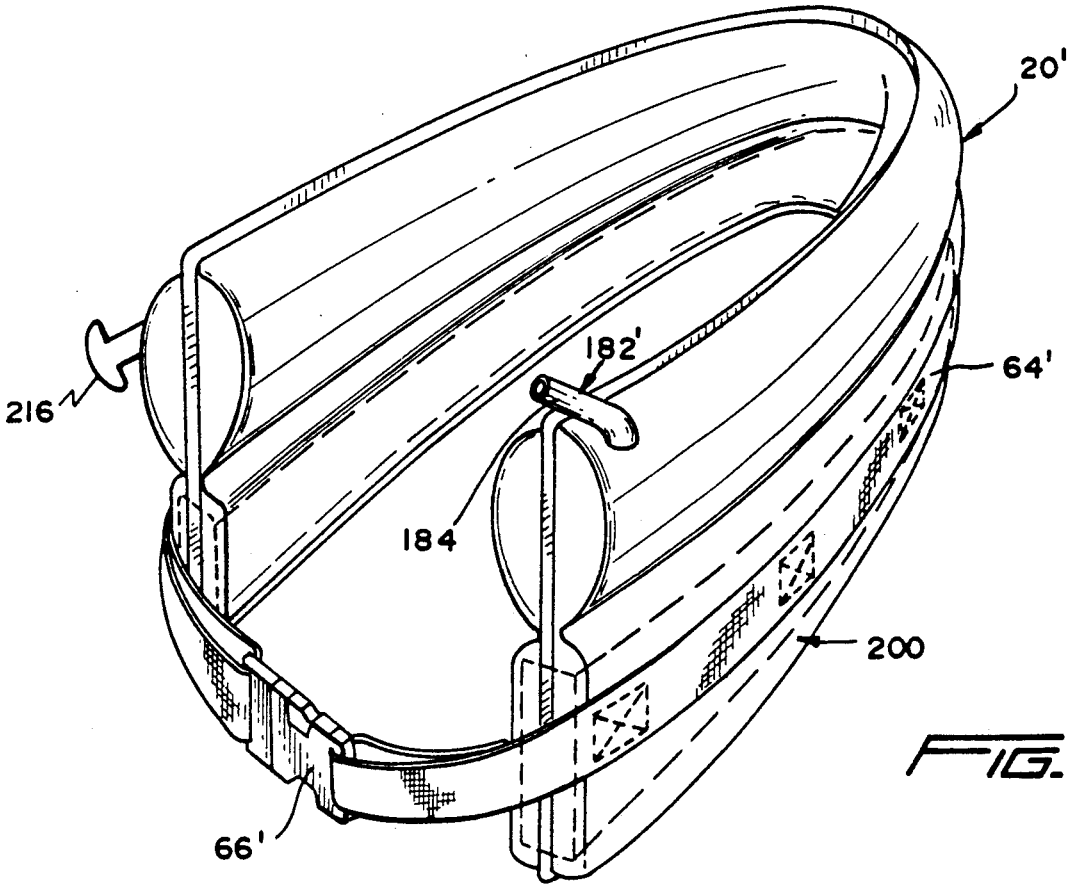
FIG. 10 is a perspective view of the form of the invention illustrated in FIG. 7, showing the same in operative position.
Figure 11:
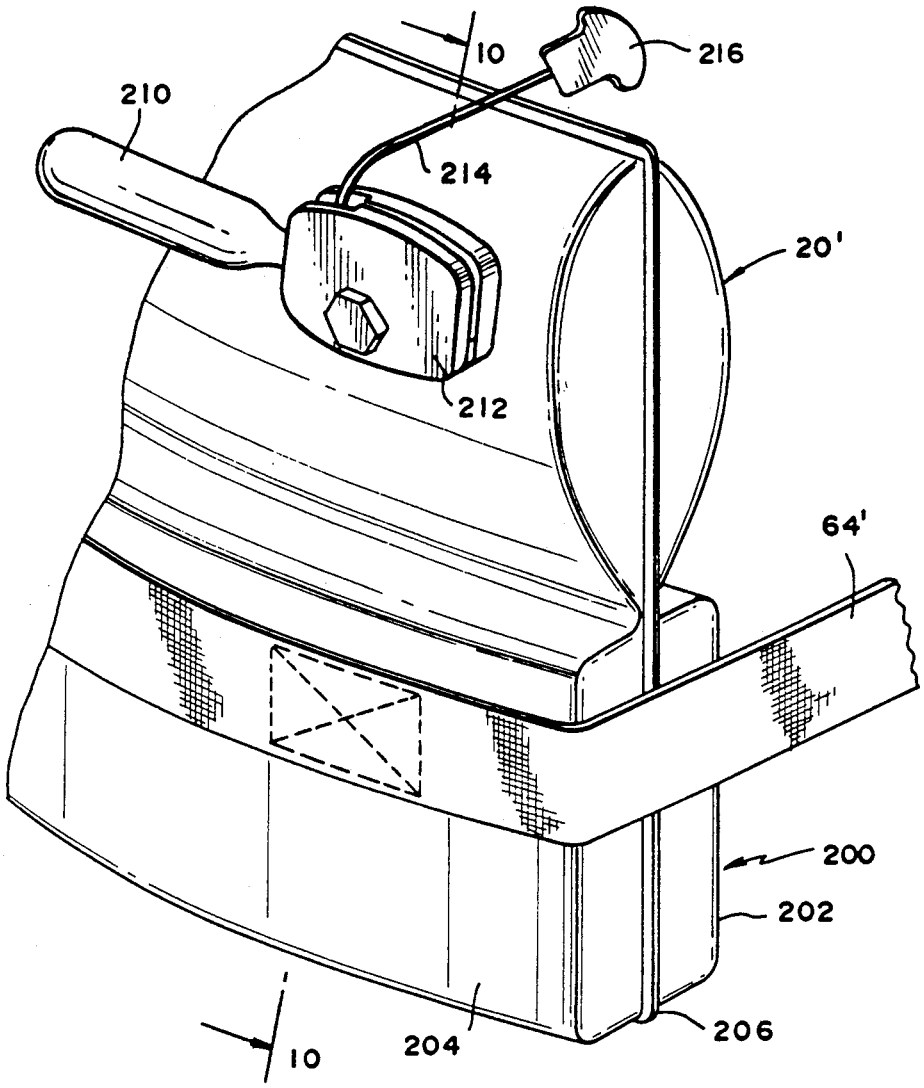
FIG. 11 is an enlarged fragmentary perspective view of the inflatable life belt as shown in FIGS. 7 and 8, showing in advantage the inflating actuator assembly.
Figure 12:
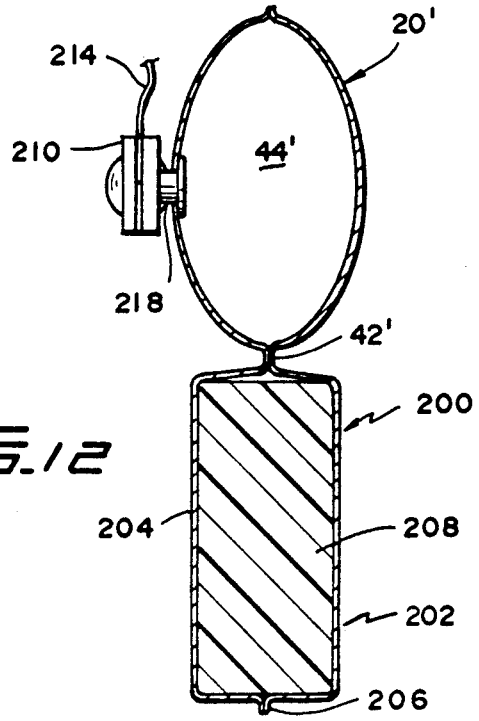
FIG. 12 is a sectional view taken along line 10—10 of FIG. 9 looking in the direction of the arrows.

As shown to advantage in FIGS. 9 and 10, inflation of inflatable portion 20' may be effected by means of a single CO2 Cartridge 210 which is actuated by conventional means such as a Halkey Roberts actuator 212 having a flexible cable 214 and a pull tab 216 to pierce gas cartridge 210 and effect passage of gas through a standard valve 218 into chamber 44' of inflatable portion 20'.

Just as in the form of invention illustrated in FIGS. 1 through 8, there is provided a manual inflation tube 182' comprising a tube 184' for manually inflating inflatable portion 20' in the event of failure of the automatic compressed gas actuating assembly.

Figure 7:
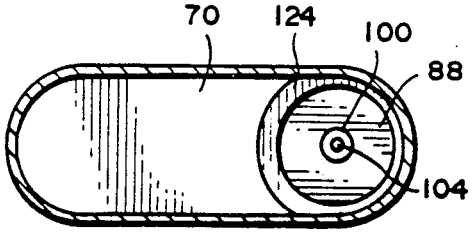
FIG. 7 is a sectional view taken along the line 7—7 of FIG. 6, looking in the direction of the arrows.
Figure 8:
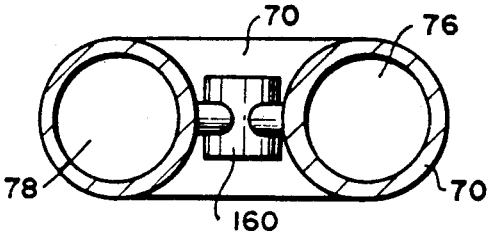
FIG. 8 is a sectional view taken along the line 8—8 of FIG. 6, looking in the direction of the arrows.

As shown in FIGS. 7 and 8, the modified form of the present life belt is worn in the same manner as in the form of the invention illustrated in FIGS. 1 through 8, with the deflated portion 20' folded over portion 200. In this position, flexible cable 214 extends forwardly between portions 20 and 200 so that pull tab 216 is readily accessible.

The inflatable portion 20' is inflated by pulling tab 216 to actuate flexible cable 214 causing gas cartridge 210 to be pierced and the compressed gas to flow into chamber 44'. As this occurs, the life belt assumes the position shown in FIG. 10, the belt rises upwardly to a point under the armpits of the wearer, and the combination of the two buoyancy portions holds the head of the person above water.

In this form of the invention, foam 208, because of its inherent buoyancy, will serve to initially keep the wearer of the life belt a float even in the absence of inflation of inflatable portion 20' so that, if inflation occurs after the wearer of the life belt enters the water, he will be kept afloat by buoyancy portion 200.

If desired, the gas cartridge inflation assembly 68 used in connection with the form of the invention illustrated in FIGS. 1 to 8, may also be used with the modified form of the invention illustrated in FIGS. 9 to 12. In the event that this is done, then both cartridges are operatively engaged with chamber 20' and, when it is desired to inflate the same, only one cartridge is actuated. In this way, a backup cartridge is available in the event of failure of the first cartridge.

While there has been herein shown and described the presently preferred forms of this invention, it is to be understood that such has been done for purposes of illustration only, and various changes may be made therein within the scope of the appended claims.

What is claimed is:

1. An inflatable life belt comprising:

a) a flexible belt member of generally flat, elongated shape for encircling the waist of the wearer;

b) a first means for detachably securing the ends of said flexible belt member together;

c) an inflatable member comprising first and second buoyancy portions;

d) each of said buoyancy portions having opposed, flexible sidewalls, the edges of which are sealed together to provide a closed chamber;

e) a sidewall of one of said buoyancy portions being engaged with the body of the wearer;

f) the other of said buoyancy portions being folded over, and engaged with the other sidewall of said one buoyancy portion and said flexible belt member, when the life belt is in the inoperative position; and, g) a second means for inflating said second buoyancy portion and effecting relocation thereof into engagement with the body of the wearer.

2. The inflatable life belt of claim 1, with the addition of:

a) a third means for inflating the second of said buoyancy portions.

3. The inflatable life belt of claim 2, wherein:

a) said third means comprises a second gas cartridge mounted in said housing;

b) a second conduit between said gas cartridge and the chamber of the other of said first and second portions; and c) a second actuating means movably mounted on said housing and engageable with said second cartridge for releasing gas therefrom through said second conduit to the chamber of the other of said first and second buoyancy portions.

4. The inflatable life belt member of claim 3, wherein:

a) each of said first and second actuating means comprises an actuating lever movably mounted in said housing, a portion of each lever lying adjacent to said gas cartridges; and b) pin members interposed between the actuating levers and gas cartridges, said actuating levers being selectively moved to force said pin members into piercing engagement with said gas cartridges to release gas therefrom to inflate the chambers of said first and second buoyancy portions.

5. The inflatable life belt of claim 1, wherein:

a) said first and second buoyancy portions are of substantially the same size.

6. The inflatable life belt of claim 1, with the addition of:

a) inherently buoyant material located in the chamber of said second buoyant portion.

7. The inflatable life belt of claim 1, wherein:

a) said second means comprises a housing;

b) a gas cartridge mounted in said housing;

c) a conduit between said housing and the chamber of one of said first and second buoyancy portions;

d) actuating means movably mounted on said housing and engageable with the gas cartridge for releasing gas therefrom for a passage through the conduit to the chamber of one of said first and second buoyancy portions.

8. The inflatable belt of claim 7, with the addition of:

a) tubular means connected to said one of said first and second buoyancy portions, one end of which tubular means is in communication with a chamber of one of said first and second buoyancy portions to permit inflation of the chamber manually.

9. An inflatable life belt comprising:

a) a flexible belt member of generally flat, elongated shape for encircling the waist of the wearer;

b) a buckle for detachably securing the ends of said flexible belt member together;

c) an inflatable member comprising opposed flexible sidewalls, the edges of which are sealed together;

d) said sidewalls being longitudinally sealed together intermediate the width thereof to provide first and second buoyancy portions of substantially the same size and having closed chambers;

e) a sidewall of said one buoyancy portion being engaged with the body of the wearer, and said second buoyancy portion being folded over said first buoyancy portion at the point where the opposed sidewalls are longitudinally sealed together intermediate the width of the sidewalls, said second buoyancy portion being engaged with the other sidewall of said one buoyancy portion and said flexible belt member when the life belt is in the inoperative position; and, f) means for inflating said second buoyancy portion, thereby effecting repositioning thereof into engagement with the wearer above said first buoyancy portion.

10. The inflatable life belt of claim 9, with the addition of:

a) an inherently buoyant material in said first buoyancy portion.

11. The inflatable life belt of claim 9, with the addition of:

a) a second means for inflating said buoyancy portion.

12. The inflatable life belt of claim 9, wherein:

a) said means includes a housing having a compressed gas cartridge therein;

b) a conduit from said compressed gas cartridge to said closed chamber of said second buoyancy portion; and c) actuating means associated with said compressed gas cartridge for releasing the compressed gas from the cartridge to permit passage thereof through said conduit to the closed chamber of said second buoyancy portion.

13. The inflatable life belt of claim 9, with the addition of:

a) a housing mounted on said life belt member;

b) a pair of compressed gas cartridges mounted in said housing; and c) conduits from each of said compressed gas cartridges in said housing to each of the closed chambers of said first and second buoyancy portions.

14. The inflatable life belt member of claim 9, with the addition of:

a) tubular means connected to one of said first and second buoyancy portions, one end of which tubular means is in communication with a chamber of one of said first and second buoyancy portions to permit inflation of the chamber manually.

* * * * *